US012268244B2

(12) United States Patent
Qiu

(10) Patent No.: US 12,268,244 B2
(45) Date of Patent: Apr. 8, 2025

(54) LIQUID GUIDING MEMBER, ATOMIZING CORE, ATOMIZER AND AEROSOL GENERATING SYSTEM

(71) Applicant: CHANGZHOU PATENT ELECTRONIC TECHNOLOGY CO., LTD, Changzhou (CN)

(72) Inventor: Weihua Qiu, Jiangsu (CN)

(73) Assignee: CHANGZHOU PATENT ELECTRONIC TECHNOLOGY CO., LTD, Changzhou (CN)

( * ) Notice: Subject to any disclaimer, the term of this patent is extended or adjusted under 35 U.S.C. 154(b) by 447 days.

(21) Appl. No.: 17/749,181

(22) Filed: May 20, 2022

(65) Prior Publication Data

US 2022/0273039 A1 Sep. 1, 2022

Related U.S. Application Data

(63) Continuation-in-part of application No. PCT/CN2020/108184, filed on Aug. 10, 2020.

(30) Foreign Application Priority Data

Nov. 22, 2019 (CN) ..... 201911158496.4

(51) Int. Cl.
*A24F 40/485* (2020.01)
*A24F 40/10* (2020.01)
(Continued)

(52) U.S. Cl.
CPC ..... *A24F 40/485* (2020.01); *A24F 40/10* (2020.01); *A24F 40/44* (2020.01); *A24F 40/46* (2020.01)

(58) Field of Classification Search
CPC ..... A24F 40/485; A24F 40/10; A24F 40/44; A24F 40/46
See application file for complete search history.

(56) References Cited

U.S. PATENT DOCUMENTS 5,369,723 A * 11/1994 Counts ..... A24D 1/20 131/194
2015/0184846 A1 7/2015 Liu
(Continued)

FOREIGN PATENT DOCUMENTS

CN 104470386 A 3/2015
CN 105092885 A 11/2015
(Continued)

OTHER PUBLICATIONS

International Search Report of PCT Patent Application No. PCT/CN2020/108184 issued on Oct. 28, 2020.
(Continued)

*Primary Examiner* — Christopher P Jones
*Assistant Examiner* — Phillip Y Shao
(74) *Attorney, Agent, or Firm* — Andrew C. Cheng

(57) ABSTRACT

A liquid guide member is provided. The liquid guide member works in cooperation with a heating member for atomizing an aerosol-forming substrate. The liquid guide member is divided into multiple areas. The area farthest from the heating member is defined as a first area, an area adjacent to the heating member is defined as the i-th area, and the area between the first area and the i-th area is defined as the x-th area, wherein the flow velocity Q of the aerosol-forming substrate in the first to i-th areas satisfies: $Q_1 \geq Q_i$, and $Q_1 > Q_x$, $1<x<i$, i being a positive integer and $i \geq 2$. The liquid guide member, atomizing core, atomizer, and aerosol generating system provided can not only reduce the risk of leakage of the aerosol-forming substrate, but also avoid the occurrence of dry burning, coking, or aerosol insufficiency.

18 Claims, 3 Drawing Sheets

(51) Int. Cl.
*A24F 40/44* (2020.01)
*A24F 40/46* (2020.01)

(56) References Cited

U.S. PATENT DOCUMENTS

| | | | |
|---|---|---|---|
| 2016/0353802 | A1 | 12/2016 | Malgat |
| 2017/0367411 | A1 | 12/2017 | Duc |
| 2018/0289068 | A1 | 10/2018 | Liao et al. |

FOREIGN PATENT DOCUMENTS

| | | | |
|---|---|---|---|
| CN | 105310114 | A | 2/2016 |
| CN | 207181111 | U | 4/2018 |
| CN | 108185530 | A | 6/2018 |
| CN | 109984387 | A | 7/2019 |
| CN | 110447962 | A | 11/2019 |
| EP | 3510880 | A1 | 7/2019 |
| WO | 2018197511 | A1 | 11/2018 |

OTHER PUBLICATIONS

CN Search Report of CN Patent Application No. 201911158496.4 issued on Dec. 2, 2021.
CN Office Action with English translation of CN Patent Application No. 201911158496.4 issued on Dec. 2, 2021.
The extended European search report of EP Patent Application No. 20889954.2 issued on Jan. 8, 2024.
The First Office Action of CN Patent Application No. 201911158496.4 issued on Dec. 2, 2021.
Search report of CN Patent Application No. 201911158496.4 issued on Dec. 2, 2021.

* cited by examiner

LIQUID GUIDING MEMBER, ATOMIZING CORE, ATOMIZER AND AEROSOL GENERATING SYSTEM

CROSS-REFERENCE TO RELATED APPLICATIONS

The present disclosure is a continuation-in-part of International Patent Application No. PCT/CN2020/108184, filed on Aug. 10, 2020, which claims priority to Chinese Patent Application No. 201911158496.4, filed on Nov. 22, 2019. All of the aforementioned patent applications are hereby incorporated by reference in their entireties.

TECHNICAL FIELD

The present disclosure relates to the technical field of aerosol generating systems, in particular to a liquid guiding member, an atomizing core, an atomizer and an aerosol generating system.

BACKGROUND

The aerosol generating system is mainly composed of two parts: the atomizing core and the battery assembly. The liquid guiding member and the heating member in the atomizing core are the core components of atomizing technology, which play a decisive role in the taste of the aerosol generating system product. In the prior art, porous ceramics are often used as the liquid guiding member of the aerosol generating system, and porous ceramics as the liquid guiding member of the aerosol generating system have the advantages of large aerosol volume, long life, and good taste. The porous ceramics used in the prior art have large pores to store aerosol-forming substrate. In this way, an excessive amount of aerosol-forming substrate will be present at the position of the heating member, and a leakage problem of the aerosol-forming substrate will occur. In addition, in order to solve the above-mentioned problems, the industry uses porous ceramics with small pores as the liquid guiding member. The porous ceramic with small pores as the liquid guiding member can not only minimize the risk of leakage of the aerosol-forming substrate, but also increase the storage space of the liquid guiding member. However, due to the small pores of the liquid guiding member, the aerosol-forming substrate will not be sufficiently transmitted from the liquid guiding member to the heating member, and dry burning, coking, or insufficient aerosol will easily occur.

SUMMARY

In view of above, the present disclosure provides a liquid guiding member which has a low risk of leakage of the aerosol-forming substrate and can avoid dry burning, coking, or insufficient aerosol.

It is also necessary to provide an atomizing core which has a low risk of leakage of the aerosol-forming substrate and can avoid dry burning, coking, or insufficient aerosol.

It is also necessary to provide an atomizer which has a low risk of leakage of the aerosol-forming substrate and can avoid dry burning, coking, or insufficient aerosol.

It is also necessary to provide an aerosol generating system which has a low risk of leakage of the aerosol-forming substrate and can avoid dry burning, coking, or insufficient aerosol.

A liquid guiding member is configured for cooperating with a heating member for atomizing an aerosol-forming substrate, wherein the liquid guiding member includes at least one porous core layer, the porous core layer farthest from the heating member is defined as the first porous core layer, and the porous core layer adjacent to the heating member is defined as the i-th porous core layer, wherein i is a positive integer and i≥1; the flow and transmission of the aerosol-forming substrate in the porous core layer of the liquid guiding member is characterized by the effective performance index E of the liquid guiding member, wherein E satisfies:

$$E = \frac{c_1 l_1 + c_2 l_2 + \ldots + c_i l_i}{\frac{l_1}{\epsilon_1 R_1} + \frac{l_2}{\epsilon_2 R_2} + \ldots + \frac{l_i}{\epsilon_i R_i}}$$

wherein E is the effective performance index of the liquid guiding member, $c_i$ is the permeability coefficient of the i-th porous core layer, $\varepsilon_i$ is the porosity of the i-th porous core layer, $R_i$ is the average pole radius of the i-th porous core layer, and $l_i$ is the thickness of the i-th porous core layer.

Further, the liquid guiding member is divided into multiple areas, the area far away from the heating member is defined as the first area, the area adjacent to the heating member is defined as the i-th area, and the area between the first area and the i-th area is defined as the x-th area; R is defined as the average pore radius of the porous core layer, the average pore radius of the porous core layer in the first area is greater than or equal to the average pore radius of the porous core layer in the i-th area, and is greater than the average pore radius of the porous core layer in the x-th area, that is, the average pore radius R in the first area to the i-th area satisfies: $R_1 \geq R_i$ and $R_1 > R_x$, $1<x<i$, i being a positive integer and i≥2.

Further, the average pore radius $R_x$ of the porous core layer in the x-th area satisfies: at least one $R_x$ is less than the average pore radius $R_i$ in the i-th area.

Further, the average pore radius $R_x$ of the porous core layer in the x-th area gradually decreases from the first area to the i-th area.

Further, the average pore radius $R_x$ of the porous core layer in the x-th area satisfies: at least one $R_x$ is not less than the average pore radius $R_i$ in the i-th area.

Further, the liquid guiding member is divided into-multiple areas, the area far away from the heating member is defined as the first area, the area adjacent to the heating member is defined as the i-th area, and the area between the first area and the i-th area is defined as the x-th area; the porosity ε of the porous core layer in the first area to the i-th area satisfies: $\varepsilon_1 \geq \varepsilon_i$ and $\varepsilon_1 > \varepsilon_x$, $1<x<i$, i being a positive integer and i≥2.

Further, the porosity $\varepsilon_x$ of the porous core layer in the x-th area satisfies: at least one $\varepsilon_x$ is less than the porosity $\varepsilon_1$ in the i-th area.

Further, the porosity $\varepsilon_x$ of the porous core layer in the x-th area gradually decreases from the first area to the i-th area.

Further, the porosity $\varepsilon_x$ of the porous core layer in the x-th area satisfies: at least one $\varepsilon_x$ is not less than the porosity $\varepsilon_t$ in the i-th area.

Further, the liquid guiding member is divided into multiple areas, the area far away from the heating member is defined as the first area, the area adjacent to the heating member is defined as the i-th area, and the area between the first area and the i-th area is defined as the x-th area; the thickness L of the porous core layer in two adjacent areas satisfies: $1 \leq L_{n-1}/L_n \leq 100$, n being a positive integer and $1<n \leq i$, i being a positive integer and $i \geq 2$.

Further, the liquid guiding member includes at least two porous core layers, each of the porous core layers corresponds to one of the areas, wherein the first porous core layer of the liquid guiding member corresponds to the first area, the x-th porous core layer of the liquid guiding member corresponds to the x-th area, and the i-th porous core layer of the liquid guiding member corresponds to the i-th area.

Further, the liquid guiding member includes only one porous core layer, and the only one porous core layer is divided into the multiple areas.

Further, a groove is formed in the x-th porous core layer, and the (x−1)-th porous core layer is accommodated in the groove of the x-th porous core layer, wherein $1<x \leq i$.

Further, a groove is formed in each porous core layer from the second porous core layer to the i-th porous core layer, and the (i−1)-th porous core layer is accommodated in the groove of the i-th porous core layer.

A liquid guiding member configured for cooperating with a heating member for atomizing an aerosol-forming substrate, wherein the liquid guiding member is divided into multiple areas, the area farthest from the heating member is defined as the first area, the area adjacent to the heating member is defined as the i-th area, and the area between the first area and the i-th area is defined as the x-th area, wherein the flow velocity Q of the aerosol-forming substrate in the first area to the i-th area satisfies: $Q_1 \geq Q_i$, and $Q_1 > Q_x$, $1<x<i$, i being a positive integer and $i \geq 2$.

Further, the flow velocity $Q_x$ of the aerosol-forming substrate in the x-th area satisfies: at least one $Q_x$ is less than the flow velocity $Q_i$ in the i-th area.

Further, the flow velocity $Q_x$ of the aerosol-forming substrate in the x-th area gradually decreases from the first area to the i-th area.

Further, the flow velocity $Q_x$ of the aerosol-forming substrate in the x-th area satisfies: at least one $Q_x$ is not less than the flow velocity $Q_i$ in the i-th area.

Further, the liquid guiding member includes at least one porous core layer; R is defined as the average pore radius of the porous core layer, the average pore radius of the porous core layer in the first area is greater than or equal to the average pore radius of the porous core layer in the i-th area, and is greater than the average pore radius of the porous core layer in the x-th area, that is, the average pore radius R in the first area to the i-th area satisfies: $R_i \geq R_i$ and $R_i > R_x$, $1<x<i$, i being a positive integer and $i \geq 2$.

Further, the average pore radius $R_x$ of the porous core layer in the x-th area satisfies: at least one $R_x$ is less than the average pore radius $R_1$ in the i-th area.

Further, the average pore radius $R_x$ of the porous core layer in the x-th area gradually decreases from the first area to the i-th area.

Further, the average pore radius $R_x$ of the porous core layer in the x-th area satisfies: at least one $R_x$ is not less than the average pore radius $R_1$ in the i-th area.

Further, the liquid guiding member includes at least one porous core layer; the porosity ε of the porous core layer in the first area to the i-th area satisfies: $\varepsilon_1 \geq \varepsilon_i$ and $\varepsilon_1 > \varepsilon_x$, $1<x<i$, i being a positive integer and $i \geq 2$.

Further, the porosity $\varepsilon_x$ of the porous core layer in the x-th area satisfies: at least one $\varepsilon_x$ is less than the porosity $\varepsilon_i$ in the i-th area.

Further, the porosity $\varepsilon_x$ of the porous core layer in the x-th area gradually decreases from the first area to the i-th area.

Further, the porosity $\varepsilon_x$ of the porous core layer in the x-th area satisfies: at least one $\varepsilon_x$ is not less than the porosity $\varepsilon_i$ in the i-th area.

Further, the thickness L of the porous core layer in two adjacent areas satisfies: $1 \leq L_n - 1/L_n \leq 100$, n being a positive integer and $1<n \leq i$.

Further, the liquid guiding member includes at least two porous core layers, each of the porous core layers corresponds to one of the areas, wherein the first porous core layer of the liquid guiding member corresponds to the first area, the x-th porous core layer of the liquid guiding member corresponds to the x-th area, and the i-th porous core layer of the liquid guiding member corresponds to the i-th area.

Further, the liquid guiding member includes only one porous core layer, and the only one porous core layer is divided into the multiple areas.

Further, a groove is formed in the x-th porous core layer, and the (x−1)-th porous core layer is accommodated in the groove of the x-th porous core layer.

Further, a groove is formed in each porous core layer from the second porous core layer to the i-th porous core layer, and the (i−1)-th porous core layer is accommodated in the groove of the i-th porous core layer.

An atomizing core includes a heating member, wherein the atomizing core further includes a liquid guiding member as described above, the heating member is arranged on the porous core layer of the liquid guiding member adjacent to the heating member.

Further, a groove is formed in the x-th porous core layer, and the (x−1)-th porous core layer is accommodated in the groove of the x-th porous core layer, wherein $1<x \leq i$.

Further, a groove is formed in each porous core layer from the second porous core layer to the i-th porous core layer, and the (i−1)-th porous core layer is accommodated in the groove of the i-th porous core layer.

Further, the liquid guiding member includes at least two porous core layers, each of the porous core layers corresponds to one of the areas, wherein the first porous core layer of the liquid guiding member corresponds to the first area, the x-th porous core layer of the liquid guiding member corresponds to the x-th area, and the i-th porous core layer of the liquid guiding member corresponds to the i-th area.

Further, the liquid guiding member includes only one porous core layer, and the only one porous core layer is divided into the multiple areas.

An atomizer includes a liquid storage chamber and an atomizing cavity in communication with the liquid storage chamber, the liquid storage chamber being configured for storing an aerosol-forming substrate, a liquid outlet being provided on a wall of the liquid storage chamber, wherein the atomizer further includes an atomizing core as described above, the liquid guiding member is in fluid communication with the liquid outlet.

Further, a groove is formed in the x-th porous core layer, and the (x−1)-th porous core layer is accommodated in the groove of the x-th porous core layer, wherein $1<x \leq i$.

Further, a groove is formed in each porous core layer from the second porous core layer to the i-th porous core layer, and the (i−1)-th porous core layer is accommodated in the groove of the i-th porous core layer.

Further, the liquid guiding member includes at least two porous core layers, each of the porous core layers corresponds to one of the areas, wherein the first porous core layer of the liquid guiding member corresponds to the first area, the x-th porous core layer of the liquid guiding member corresponds to the x-th area, and the i-th porous core layer of the liquid guiding member corresponds to the i-th area.

Further, the liquid guiding member includes only one porous core layer, and the only one porous core layer is divided into the multiple areas.

An aerosol generating system includes a battery assembly, an airflow channel and an atomizer as described above, wherein the airflow channel is in communication with the atomizing cavity, the airflow channel is configured for the aerosol flowing out from the atomizing cavity to be discharged to the outside for people to inhale, the battery assembly is electrically connected to the heating member, and the battery assembly is configured to provide the heating member with electrical energy required to atomize the aerosol-forming substrate.

Further, a groove is formed in the x-th porous core layer, and the (x−1)-th porous core layer is accommodated in the groove of the x-th porous core layer, wherein $1<x\leq i$.

Further, a groove is formed in each porous core layer from the second porous core layer to the i-th porous core layer, and the (i−1)-th porous core layer is accommodated in the groove of the i-th porous core layer.

Further, the liquid guiding member includes at least two porous core layers, each of porous core layers corresponds to one of the areas, wherein the first porous core layer of the liquid guiding member corresponds to the first area, the x-th porous core layer of the liquid guiding member corresponds to the x-th area, and the i-th porous core layer of the liquid guiding member corresponds to the i-th area.

Further, the liquid guiding member includes only one porous core layer, and the only one porous core layer is divided into the multiple areas.

The atomizing core, the atomizer and the aerosol generating system of the present disclosure include a liquid guiding member respectively, and the liquid guiding member includes at least one porous core layer. The flow velocity $Q_1$ of the aerosol-forming substrate in the porous core layer of the first area is greater than or equal to the flow velocity $Q_i$ of the aerosol-forming substrate in the porous core layer of the i-th area, and is greater than the flow velocity $Q_x$ of the aerosol-forming substrate in the porous core layer of the x-th area, so as to control the speed of the aerosol-forming substrate flowing out from the porous core layer in the area adjacent to the heating member (i.e., the i-th area), thereby reducing the risk of leakage of the aerosol-forming substrate and ensure that the aerosol-forming substrate is sufficiently transmitted from the liquid guiding member to the heating member. Thus, the phenomenon of dry burning, coking or insufficient aerosol can be avoided.

Figure 1:
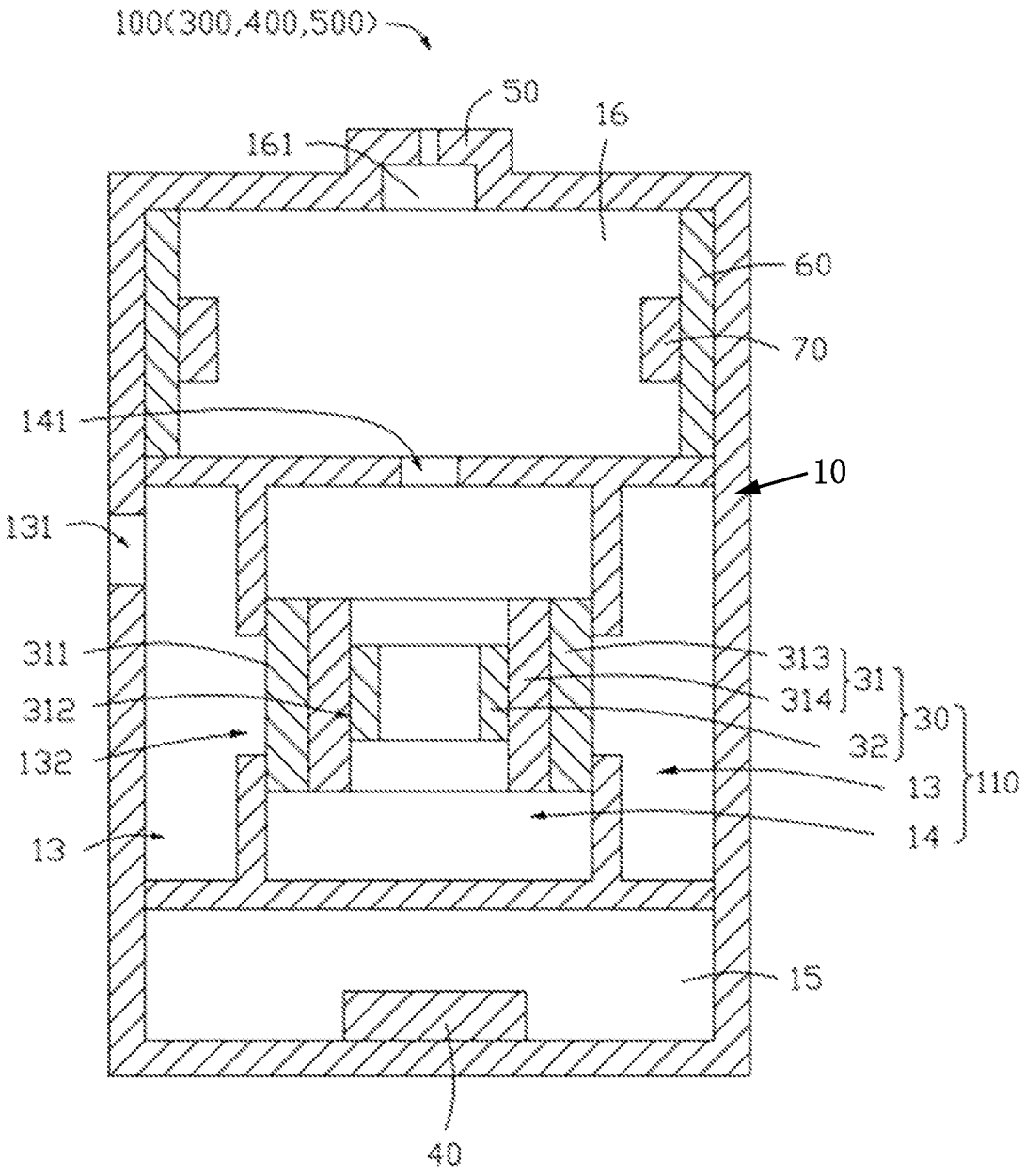
FIG. 1 is a schematic diagram of an aerosol generating system according to the first, second, third, and fourth embodiments of the present disclosure.

aerosol generating system 100, 200, 300, 400, 500
atomizer 110
housing assembly 10
liquid storage chamber 13
liquid injection hole 131
liquid outlet 132
atomizing cavity 14, 17
aerosol outlet 141, 171
battery cavity 15
airflow channel 16
air outlet 161
atomizing core 30
liquid guiding member 31, 33
absorbing surface 311
atomizing surface 312
first porous core layer 313, 315
second porous core layer 314, 316
groove 3161
heating member 32, 34
battery assembly 40
mouthpiece 50
thermal insulation layer 60
liquid absorbing member 70

Specific embodiments given below will be combined with the above drawings to further describe the present disclosure.

DETAILED DESCRIPTION OF PREFERRED EMBODIMENTS

The technical solution of the present disclosure will be described clearly and completely below with reference to the embodiments shown in FIGS. 1-3. Obviously, the described embodiments are only some of the embodiments of the present disclosure, rather than all of the embodiments. Based on the description of the present disclosure, all other embodiments obtained by a person of ordinary skill in the art without creative work shall fail within the protection scope of the present disclosure.

It should be noted that when an element is referred to as being "connected to" another element, it can be directly connected to the other element or intervening elements may also be present.

Unless defined otherwise, all technical and scientific terms used herein have the same meaning as commonly understood by one of ordinary skill in the art to which this disclosure belongs. The terms used herein in the description of the present disclosure are only for the purpose of describing specific embodiments, and are not intended to limit the present disclosure.

Figure 2:
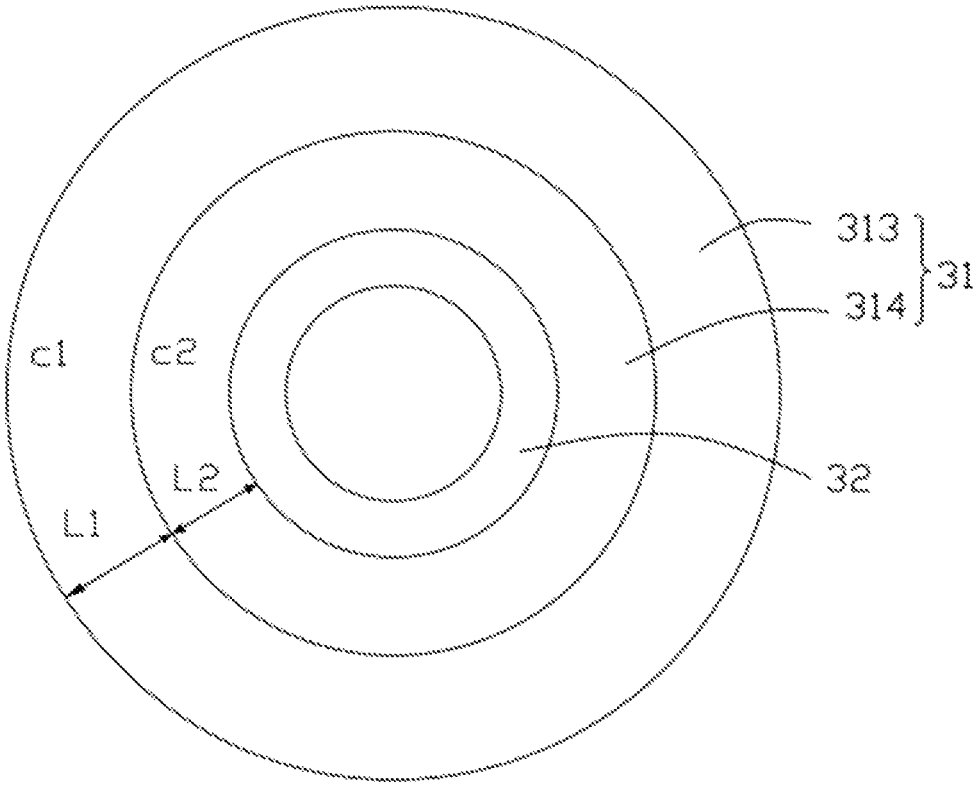
FIG. 2 is a top view of the liquid guiding member shown in FIG. 1.

Referring to FIGS. 1-2, the first embodiment of the present disclosure provides an aerosol generating system 100. The aerosol generating system 100 includes a housing assembly 10, an atomizing core 30, and a battery assembly 40. The atomizing core 30 and the battery assembly 40 are received in the housing assembly 10 and the battery assembly 40 is electrically connected to the atomizing core 30.

In this embodiment, the housing assembly 10 is provided with a liquid storage chamber 13, an atomizing cavity 14, a battery cavity 15 and an airflow channel 16 therein. The liquid storage chamber 13, the atomizing cavity 14 and the atomizing core 30 constitute an atomizer 110. Therefore, the aerosol generating system 100 can also be considered to be composed of the battery cavity 15, the airflow channel 16, the atomizer 110 and the battery assembly 40.

In other embodiments, the battery cavity 15 may be not included in the housing assembly 10, but detachably installed with the housing assembly 10. That is, the battery assembly 40 and the atomizer 110 are detachably installed together.

It can be understood that, in other embodiments, the atomizer 110 can be provided separately from the liquid storage chamber 13, for example, the atomizer 110 and the battery assembly 40 are installed together and the liquid storage device with the liquid storage chamber 13 is provided separately.

The liquid storage chamber 13 is in communication with the atomizing cavity 14, and the atomizing cavity 14 is in communication with the airflow channel 16. The liquid storage chamber 13 is configured to store the aerosol-forming substrate. The atomizing cavity 14 is configured for accommodating the atomizing core 30. The battery cavity 15 is configured for accommodating the battery assembly 40. The airflow channel 16 is configured to allow the aerosol flowing out of the atomizing cavity 14 to the outside for people to inhale.

In this embodiment, a liquid injection hole 131 and a liquid outlet 132 are provided on the wall of the liquid storage chamber 13. The liquid injection hole 131 is configured for injecting an aerosol-forming substrate into the liquid storage chamber 13. The liquid outlet 132 is in fluid communication with the atomizing core 30, and the liquid storage chamber 13 is in communication with the atomizing cavity 14 through the liquid outlet 132. The liquid outlet 132 is configured to allow the aerosol-forming substrate to enter the atomizing core 30, and the atomizing core 30 atomizes the aerosol-forming substrate to generate aerosol.

In other embodiments, the liquid storage chamber 13 is not provided with a liquid injection hole 131, especially for a disposable aerosol generating system that cannot be repeatedly injected with liquid.

An aerosol outlet 141 is provided on the wall of the atomizing cavity 14. The atomizing cavity 14 is in communication with the airflow channel 16 through the aerosol outlet 141. The aerosol outlet 141 is configured to allow the aerosol formed by atomizing the aerosol-forming substrate entering the atomizing core 30 by the atomizing core 30 to flow into the airflow channel 16.

An air outlet 161 is provided on the wall of the airflow channel 16. The air outlet 161 is configured to allow the aerosol to flow from the airflow channel 16 to the outside for people to inhale.

In other embodiments, the housing assembly 10 is further provided with an air inlet (not shown). When the aerosol generating system 100 is in use, the external airflow enters from the air inlet, and the aerosol atomized by the atomizing core 30 passes through the airflow channel 16 together with the airflow, and flows out from the air outlet 161 for people to inhale.

The atomizing core 30 is configured to atomize the aerosol-forming substrate entering the atomizing core 30 into aerosol. The atomizing core 30 includes a liquid guiding member 31 and a heating member 32. The liquid guiding member 31 is fixed on the inner wall of the atomizing cavity 14 and is in fluid communication with the liquid outlet 132. Preferably, a sealing member (not shown) is provided between the liquid guiding member 31 and the inner wall of the atomizing cavity 14, and the sealing member is arranged around the liquid outlet 132 to prevent the aerosol-forming substrate from leaking into the atomizing cavity 14 without passing through the liquid guiding member 31. The liquid guiding member 31 includes an absorbing surface 311 and an atomizing surface 312. The absorbing surface 311 is arranged facing the liquid outlet 132, and the atomizing surface 312 is arranged opposite to the absorbing surface 311. The heating member 32 is fixed or formed on the atomizing surface 312 of the liquid guiding member 31, so that the aerosol-forming substrate transmitted from the absorbing surface 311 to the atomizing surface 312 can be atomized into aerosol.

It can be understood that the liquid guiding member 31 can be fixed in the atomizing cavity 14 by a fixing member (not shown), and the liquid guiding member 31 is attached to the inner wall of the atomizing cavity 14 by itself or by another liquid guiding member, to absorb the aerosol-forming substrate flowing out from the liquid outlet 132. Alternatively, the liquid guiding member 31 partially extends from the atomizing cavity 14 to the liquid outlet 13 to absorb the aerosol-forming substrate.

The liquid guiding member 31 is divided into multiple areas, wherein the area adjacent to the liquid outlet 132 is defined as the first area, the area adjacent to the heating member 32 is defined as the i-th area, and the area between the first area and the i-th area is defined as the x-th area. The flow velocity Q of the aerosol-forming substrate in the first area to the i-th area satisfies: and $Q_1 \geq Q_i$, $Q_1 > Q_x$, $1<x<i$, i being a positive integer and $i \geq 2$.

In one embodiment, the flow velocity $Q_x$ of the aerosol-forming substrate in the x-th area further satisfies: at least one $Q_x$ is less than the flow velocity $Q_i$ in the i-th area.

In one embodiment, the flow velocity $Q_x$ of the aerosol-forming substrate in the x-th area gradually decreases from the first area to the i-th area.

In one embodiment, the flow velocity $Q_x$ of the aerosol-forming substrate in the x-th area further satisfies: at least one $Q_x$ is not less than the flow velocity $Q_i$ in the i-th area.

The liquid guiding member 31 includes at least one porous core layer. R is defined as the average pore radius of the porous core layer, wherein the average pore radius of the porous core layer in the first area is greater than or equal to the average pore radius of the porous core layer in the i-th area, and greater than the average pore radius of the porous core layer in the x-th area, that is, the average pore radius R in the first area to the i-th area satisfies: $R_1 \geq R_i$ and $R_1 > R_x$, $1<x<i$, i being a positive integer and $i \geq 2$.

In one embodiment, the average pore radius $R_x$ of the porous core layer in the x-th area further satisfies: at least one $R_x$ is less than the average pore radius $R_i$ in the i-th area. Further, the average pore radius $R_x$ of the porous core layer in the x-th area gradually decreases from the first area to the i-th area. Preferably, $R_{i-1} \geq 1.2R_i$.

In one embodiment, the average pore radius $R_x$ of the porous core layer in the x-th area further satisfies: at least one $R_x$ is not less than the average pore radius $R_i$ in the i-th area.

In this embodiment, the liquid guiding member 31 includes at least two porous core layers, and each of the porous core layers corresponds to one of the areas. That is, the first porous core layer of the liquid guiding member 31 corresponds to the first area, the x-th porous core layer of the liquid guiding member 31 corresponds to the x-th area, and the i-th porous core layer of the liquid absorbing member 31 corresponds to the i-th area.

The porous core layers are made of porous materials, such as ceramic materials. The ceramic materials include oxides and non-oxides, for example, metal oxides, silicates, carbides and nitrides.

The porous core layers can be prepared by one of the methods such as sintering of filler particles, addition of pore-forming agent, organic foam impregnation, gel injection molding process, freeze drying, or the like. In this embodiment, the porous core layers are prepared by adding pore-forming agent.

Specifically, the method of adding pore-forming agent to prepare the porous core layers includes the following steps: first, ceramic powder is mixed with a pore-forming agent to obtain a mixture. The pore-forming agent is usually carbon or an organic material, such as starch, polymethyl methacrylate (MAMA), etc. Second, the mixture is formed into the shape of the above-mentioned liquid guiding member 31 using a conventional ceramic forming method, which can be powder pressing, belt casting or injection molding, to obtain a green product. Third, the green product is fired at a high temperature to remove the pore-forming agent, so as to solidify the green product into a monolithic piece.

In this embodiment, the liquid guiding member 31 includes a first porous core layer 313 and a second porous core layer 314. The first porous core layer 313 is fixed on the wall of the atomizing cavity 14 and faces the liquid outlet 132. The second porous core layer 314 is formed on the first porous core layer 313, wherein the absorbing surface 311 is one surface of the first porous core layer 313 facing the liquid outlet 132, and the atomizing surface 312 is one surface of the second porous core layer 314 away from the porous core layer 313.

The first porous core layer 313 and the second porous core layer 314 are both made of porous materials. In this embodiment, the first porous core layer 313 and the second porous core layer 314 are made of porous ceramic materials. The ceramic materials include oxides and non-oxides, for example, metal oxides, silicates, carbides and nitrides. The porous ceramic has a large specific surface area and strong absorption capacity, which can make the aerosol-forming substrate in the liquid storage chamber 13 enter the liquid guiding member 31 and be introduced to the heating member 32.

In other embodiments, the first porous core layer 313 and the second porous core layer 314 can also be made of other porous materials.

In this embodiment, the first porous core layer 313 and the second porous core layer 314 each have a hollow cylindrical shape. The first porous core layer 313 and the second porous core layer 314 share a common center of circle.

The performance of the liquid guiding member 31 can be characterized by Equation 1 in which E is the effective performance index of the liquid guiding member 31. E is related to the structure of the porous core layers, and E is used for characterizing the flow and transmission of the aerosol-forming substrate in the porous core layers of the liquid guiding member 31, thereby for characterizing the change of the flow velocity of the aerosol-forming substrate in the liquid guiding member 31. In the present disclosure, E is related to the porosity, average pore radius, permeability coefficient, and thickness of the liquid guiding member 31. The porosity, average pore radius and thickness of the liquid guiding member 31 can be artificially set, and the permeability coefficient can be determined by Equation 2 or Equation 3.

$$E = \frac{c_1 l_1 + c_2 l_2 + \ldots + c_i l_i}{\frac{l_1}{\epsilon_1 R_1} + \frac{l_2}{\epsilon_2 R_2} + \ldots + \frac{l_i}{\epsilon_i R_i}} \quad \text{(Equation 1)}$$

E is the effective performance index of the liquid absorbing member 31, $l_1$ is the thickness of the first porous core layer 313, $l_2$ is the thickness of the second porous core layer 314, $\varepsilon_1$ is the porosity of the first porous core layer 313, $\varepsilon_2$ is the porosity of the second porous core layer 314, $R_1$ is the average pore radius of the first porous core layer 313, $R_2$ is the average pore radius of the second porous core layer 314, $c_1$ is the permeability coefficient of the first porous core layer 313, $c_2$ is the permeability coefficient of the second porous core layer 314, $\varepsilon_i$ is the porosity of the i-th porous core layer, $R_i$ is the average pore radius of the i-th porous core layer, and $l_i$ is the thickness of the i-th porous core layer.

It can be known from Equation 1 that when the porosity ε decreases, the effective performance index E decreases; when the average pore radius R decreases, the effective performance index E decreases; the decrease of the effective performance index E indicates that the flow and transmission of the aerosol-forming substrate in the liquid guiding member 31 becomes slower. Therefore, in the same time; the amount of the aerosol-forming substrate flowing out from the porous core layer of the liquid guiding member 31 adjacent to the heating member 32 is reduced, to thereby reduce the risk of leakage of the aerosol-forming substrate and ensure that the aerosol-forming substrate is sufficiently transmitted from the liquid guiding member 31 to the heating member 32. Thus, the phenomenon of dry burning, coking or insufficient aerosol can be avoided.

The structural properties of the liquid guiding member 31 can be characterized by a standard porous material characterization test method (e.g., mercury intrusion porosity measurement method). For the liquid guiding member 31 of this embodiment, the structural properties of the liquid guiding member 31 can be obtained through experiments based on Equation 2 or Equation 3 to obtain the permeability coefficient $c_i$ each time. Equation 2 and Equation 3 are the variant of the percolation equation. Those skilled in the art can measure the flow velocity Q of the aerosol-forming substrate in Equations 2 and 3 through the standard porous material characterization test method, and then calculate the permeability coefficient $c_i$ through Equations 2 and 3, $$Q = c_i A_i \cdot \left(\frac{3(1-\varepsilon_i)\gamma\cos\theta}{\varepsilon_i l_i R_i}\right) \cdot \frac{\varepsilon_i^3 R_i^2}{\mu(1-\varepsilon_i)^2} \quad \text{(Equation 2)}$$

$$\text{or, } Q = c_i A_i \cdot \left(\frac{3(1-\varepsilon_i)\gamma\cos\theta}{\varepsilon_i l_i R_i} - \rho g\right) \cdot \frac{\varepsilon_i^3 R_i^2}{\mu(1-\varepsilon_i)^2} \quad \text{(Equation 3)}$$

Q is the flow velocity of the aerosol-forming substrate, $A_i$ is the cross-sectional area of the i-th porous core layer, $l_i$ is the thickness of the i-th porous core layer, $\varepsilon_i$ is the porosity of the i-th porous core layer, $R_i$ is the average pore radius of the i-th porous core layer, μ is the dynamic viscosity of the aerosol-forming substrate, θ is the contact angle of the gas-liquid system, γ is the surface tension of the aerosol-forming substrate, ρ is the density of the aerosol-forming substrate, and g is the gravitational constant.

It can be known from the simplified variants Equation 2 and Equation 3 that when the porosity ε (ε≤0.6) decreases, the flow velocity Q of the aerosol-forming substrate decreases; when the average pore radius R decreases, the flow velocity Q of the aerosol-forming substrate decreases; the decrease of the flow velocity Q of the aerosol-forming substrate indicates that the flow and transmission of the aerosol-forming substrate in the liquid guiding member 31 becomes slower. Therefore, in the same time, the amount of the aerosol-forming substrate flowing out from the porous core layer of the liquid guiding member 31 adjacent to the heating member 32 is reduced, to thereby reduce the risk of leakage of the aerosol-forming, substrate and ensure that the aerosol-forming substrate is sufficiently transmitted from the liquid guiding member 31 to the heating member 32. Thus, the phenomenon of dry burning, coking or insufficient aerosol can be avoided.

The heating member 32 can be a heating coating, a heating coil, a heating sheet, a heating net, a printed circuit formed on the liquid guiding member 31, or the like. In this embodiment, the heating member 32 is a heating sheet.

In this embodiment, the heating member 32 is a spiral columnar heating sheet, the outer wall surface of the heating member 32 and the atomizing surface 312 are in contact with each other. In this way, the heating member 32 can atomize and uniformly heat the aerosol-forming substrate, and the heating temperature is consistent, so that the atomized particles will not be large due to the local temperature being too low, which effectively ensures the uniformity of the atomized particles and improves the taste of the aerosol generating system. At the same time, the contact area between the heating member 32 and the aerosol-forming substrate can also be increased, so that the atomizing efficiency can be improved.

The battery assembly 40 is received in the battery cavity 15 and is electrically connected to the heating member 32. The battery assembly 40 is configured to provide the heating member 32 with electrical energy required to atomize the aerosol-forming substrate.

In this embodiment, the aerosol generating system 100 further includes a mouthpiece 50, the mouthpiece 50 is in communication with the airflow channel 16 through the air outlet 161, and the aerosol flowing out via the air outlet 161 of the airflow channel 16 flows out of the mouthpiece 50 for people to inhales. In other embodiments, the aerosol generating system 100 may also not include the mouthpiece 50.

In another embodiment, the aerosol generating system 100 further includes a thermal insulation layer 60, and the thermal insulation layer 60 is disposed on the inner wall of the airflow channel 16. The thermal insulation layer 60 is beneficial to prevent heat dissipation in the airflow channel 16, which can prevent the aerosol from rapidly cooling and condensing into smoke liquid on the inner wall of the airflow channel 16 caused by the temperature in the airflow channel 16 dropping too quickly.

In another embodiment, the aerosol generating system 100 further includes a liquid absorbing member 70, the liquid absorbing member 70 is disposed on the thermal insulation layer 60, and the liquid absorbing member 70 is configured for absorbing the condensed smoke liquid. The liquid absorbing member 70 has a hollow cylindrical shape or other shapes. The liquid absorbing member 70 is made of porous material, for example, super absorbent resin/sponge/cotton/paper/porous ceramic or other porous materials.

In another embodiment, the aerosol generating system 100 further includes a liquid absorbing member 70, and the liquid absorbing member 70 is arranged on the inner wall of the airflow channel 16.

Referring to FIGS. 1-2, the second embodiment of the present disclosure provides an aerosol generating system 300. The aerosol generating system 300 is similar in structure to the aerosol generating system 100, except that the porosity ε of the porous core layer in the first area to the i-th area satisfies: $\varepsilon_1 \geq \varepsilon_i$ and $\varepsilon_1 > \varepsilon_x$, $1<x<I$, wherein i is a positive integer and $i \geq 2$.

In one embodiment, the porosity $\varepsilon_x$ of the porous core layer in the x-th area further satisfies: at least one $\varepsilon_x$ is less than the porosity $\varepsilon_i$ in the i-th area.

In one embodiment, the porosity $\varepsilon_x$ of the porous core layer in the x-th area gradually decreases from the first area to the i-th area. Preferably, $\varepsilon \leq 0.6$.

In one embodiment, the porosity ε, of the porous core layer in the x-th area further satisfies: at least one $\varepsilon_x$ is not less than the porosity $\varepsilon_i$ in the i-th area.

Of course, in other embodiments, the aerosol generating system 300 may also at the same time satisfy the limiting conditions regarding R in the aerosol generating system 100.

Referring to FIGS. 1-2, the third embodiment of the present disclosure provides an aerosol generating system 400. The aerosol generating system 400 is similar in structure to the aerosol generating system 100 or 300, except that the thickness of the porous core layer in two adjacent areas satisfies: $1 \leq L_{n-1}/L_n \leq 100$, wherein n is a positive integer and $1<n \leq i$, i is a positive integer and $i \geq 2$.

Of course, in other embodiments, the aerosol generating system 400 may also at the same time satisfy the limiting conditions regarding R and c in the aerosol generation system 100 and the aerosol generating system 300.

Referring to FIGS. 1-2, the fourth embodiment of the present disclosure provides an aerosol generating system 500. The aerosol generating system 500 is similar in structure to the aerosol generating system 100 or 300 or 400, except that the liquid guiding member 31 only includes one porous core layer, and the only one porous core layer is also divided into multiple areas, the flow velocity Q of the aerosol-forming substrate in the first area to the i-th area satisfies: $Q_1 \geq Q_i$, and $Q_1 > Q_x$, $1<x<i$, i being a positive integer and $i \geq 2$.

Of course, in other embodiments, the aerosol generating system 500 may also at the same time satisfy the limiting conditions regarding R, ε and L in the aerosol generating system 100 or 300 or 400.

Figure 3:
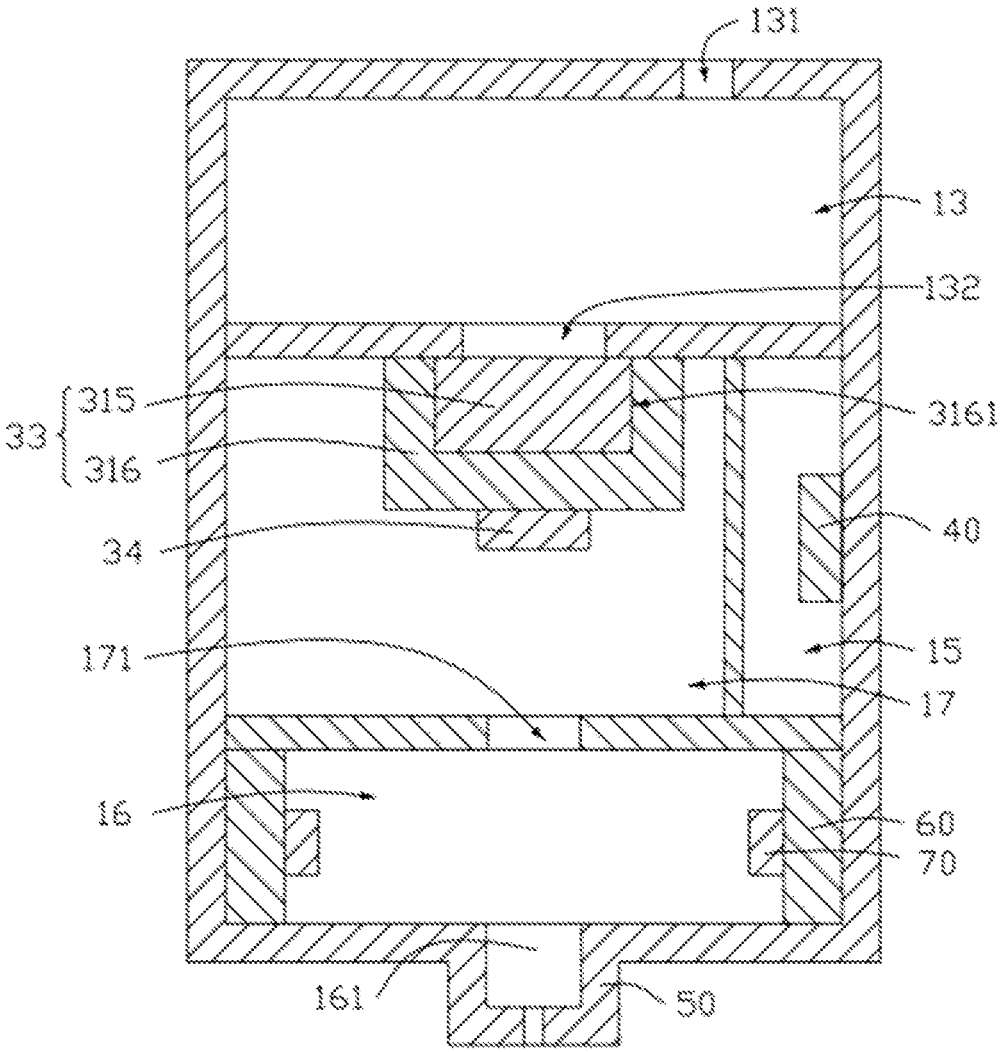
FIG. 3 is a schematic diagram of an aerosol generating system according to the fifth embodiment of the present disclosure.

Referring to FIG. 3, the fifth embodiment of the present disclosure provides an aerosol generating system 200. The structure of the aerosol generating system 200 is basically the same as the structure of the aerosol generating system 100 or 300 or 400, and the only difference is in that a groove 3161 is formed in the x-th porous core layer of the liquid guiding member 33 of the aerosol generating system 200, the (x−1)-th porous core layer is accommodated in the groove 3161 of the x-th porous core layer, wherein $1<x \leq i$, i is a positive integer and $i \geq 2$. The heating member 34 is fixed on the surface (atomizing surface) of the i-th porous core layer. The thickness of the porous core layer with the groove 3161 refers to the distance from the bottom of the groove 3161 to the surface of the porous core layer away from the opening of the groove 3161.

In other embodiments, a groove 3161 is formed in each porous core layer from the second porous core layer to the i-th porous core layer, and the (i−1)-th porous core layer is accommodated in the groove 3161 of the i-th porous core layer.

Specifically, in this embodiment, the liquid guiding member 33 includes a first porous core layer 315 and a second porous core layer 316. A groove 3161 is formed in the second porous core layer 316, and the first porous core layer 315 is received and fixed in the groove 3161. The first porous core layer 315 is fixed on the inner wall of the atomizing cavity 17 of the aerosol generating system 200 and is disposed facing the liquid outlet 132. Preferably, the second porous core layer 316 wraps around the first porous core layer 315 and is fixed on the inner wall of the atomizing cavity 17 of the aerosol generating system 200.

Of course, in other embodiments, the aerosol generating system 200 may also at the same time satisfy the limiting conditions regarding R, ε and L in the aerosol generating systems 100, 300, and 400.

The performance of the liquid guiding member 31 can be characterized by Equation 1 in which E is the effective performance index of the liquid guiding member 33. E is related to the structure of the porous core layers, and E is used for characterizing the flow and transmission of the aerosol-forming substrate in the porous core layers of the liquid guiding member 33, thereby for characterizing the change of the flow velocity of the aerosol-forming substrate in the liquid guiding member 33. In the present disclosure, E is related to the porosity, average pore radius, permeability coefficient and thickness of the liquid guiding member 33. The porosity, average pore radius and thickness of the liquid guiding member 33 can be artificially set, and the permeability coefficient can be determined by Equation 2 or Equation 3.

$$E = \frac{c_1 l_1 + c_2 l_2 + \ldots + c_i l_i}{\frac{l_1}{\epsilon_1 R_1} + \frac{l_2}{\epsilon_2 R_2} + \ldots + \frac{l_i}{\epsilon_i R_i}} \quad \text{(Equation 1)}$$

E is the effective performance index of the liquid guiding member 33, $l_1$ is the thickness of the first porous core layer 315, is the thickness of the second porous core layer 316, $\varepsilon_1$ is the porosity of the first porous core layer 315, $\varepsilon_2$ is the porosity of the second porous core layer 316, $R_1$ is the average pore radius of the first porous core layer 315, $R_2$ is the average pore radius of the second porous core layer 316, $c_1$ is the permeability coefficient of the first porous core layer 315, $c_2$ is the permeability coefficient of the second porous core layer 316, $\varepsilon_i$ is the porosity of the i-th porous core layer, $R_i$ is the average pore radius of the i-th porous core layer, and $l_i$ is the thickness of the i-th porous core layer.

It can be known from Equation 1 that when the porosity a decreases, the effective performance index E decreases; when the average pore radius R decreases, the effective performance index E decreases; the decrease of the effective performance index E indicates that the flow and transmission of the aerosol-forming substrate in the liquid guiding member 33 becomes slower. Therefore, in the same time, the amount of the aerosol-forming substrate flowing out from the porous core layer of the liquid guiding member 33 adjacent to the heating member 34 is reduced, to thereby reduce the risk of leakage of the aerosol-forming substrate and ensure that the aerosol-forming substrate is sufficiently transmitted from the liquid guiding member 33 to the heating member 34. Thus, the phenomenon of dry burning, coking or insufficient aerosol can be avoided.

The structural properties of the liquid guiding member 33 can be characterized by a standard porous material characterization test method (e.g., mercury intrusion porosity measurement method). For the liquid guiding member 33 of this embodiment, the structural properties of the liquid guiding member 33 can be obtained through experiments based on Equation 2 and Equation 3 to obtain the permeability coefficient $c_i$ each time. Equation 2 and Equation 3 are the variant of the percolation Equation. Those skilled in the art can measure the flow velocity Q of the aerosol-forming substrate in Equations 2 and 3 through the standard porous material characterization test method, and then calculate the permeability coefficient $c_i$ through Equations 2 and 3.

$$Q = c_i A_i \cdot \left(\frac{3(1-\varepsilon_i)\gamma\cos\theta}{\varepsilon_i l_i R_i}\right) \cdot \frac{\varepsilon_i^3 R_i^2}{\mu(1-\varepsilon_i)^2} \quad \text{(Equation 2)}$$

$$\text{or, } Q = c_i A_i \cdot \left(\frac{3(1-\varepsilon_i)\gamma\cos\theta}{\varepsilon_i l_i R_i} - \rho g\right) \cdot \frac{\varepsilon_i^3 R_i^2}{\mu(1-\varepsilon_i)^2} \quad \text{(Equation 3)}$$

Q is the flow velocity of the aerosol-forming substrate, $A_i$ is the cross-sectional area of the i-th porous core layer, $l_i$ is the thickness of the i-th porous core layer, $\varepsilon_i$ is the porosity of the i-th porous core layer, $R_i$ is the average pore radius of the i-th porous core layer, $\mu$ is the dynamic viscosity of the aerosol-forming substrate, $\rho$ is the density of the aerosol-forming substrate, $\theta$ is the contact angle of the gas-liquid system, $\gamma$ is the surface tension of the aerosol-forming substrate, g is the gravitational constant.

It can be known from the simplified variants Equation 2 and Equation 3 that when the porosity $\varepsilon$ ($\varepsilon \leq 0.6$) decreases, the flow velocity Q of the aerosol-forming substrate decreases; when the average pore radius R decreases, the flow velocity Q of the aerosol-forming substrate decreases; the decrease of the flow velocity Q of the aerosol-forming substrate indicates that the flow and transmission of the aerosol-forming substrate of the liquid guiding member 33 becomes slower. Therefore, in the same time, the amount of the aerosol-forming substrate flowing out from the porous core layer of the liquid guiding member 33 adjacent to the heating member 34 is reduced, to thereby reduce the risk of leakage of the aerosol-forming substrate and ensure that the aerosol-forming substrate is sufficiently transmitted from the liquid guiding member 33 to the heating member 34. Thus, the phenomenon of dry burning, coking or insufficient aerosol can be avoided.

The atomizing core, the atomizer and the aerosol generating system of the present disclosure include a liquid guiding member respectively, and the liquid guiding member includes at least one porous core layer. The flow velocity $Q_1$ of the aerosol-forming substrate in the porous core layer of the first area is greater than or equal to the flow velocity $Q_i$ of the aerosol-forming substrate in the porous core layer of the i-th area, and is greater than the flow velocity $Q_x$ of the aerosol-forming substrate in the porous core layer of the x-th area, so as to control the speed of the aerosol-forming substrate flowing out from the porous core layer in the area adjacent to the heating member (i.e., the i-th area, thereby reducing the risk of leakage of the aerosol-forming substrate and ensure that the aerosol-forming substrate is sufficiently transmitted from the liquid guiding member to the heating member. Thus, the phenomenon of dry burning, coking or insufficient aerosol can be avoided.

What is claimed is:

1. A liquid guiding member configured for cooperating with a heating member for atomizing an aerosol-forming substrate, wherein the liquid guiding member is divided into multiple areas, the area farthest from the heating member is defined as a first area, the area adjacent to the heating member is defined as an i-th area, and the area between the first area and the i-th area is defined as an x-th area, wherein a flow velocity Q of the aerosol-forming substrate in the first area to the i-th area satisfies: $Q_1 \geq Q_i$, and $Q_1 > Q_x$, $1 < x < i$, i being a positive integer and $i > 2$; and wherein the flow velocity $Q_x$ of the aerosol-forming substrate in the x-th area satisfies: at least one $O_x$ is less than the flow velocity $Q_i$ in the i-th area.

2. The liquid guiding member according to claim 1, wherein the flow velocity $Q_x$ of the aerosol-forming substrate in the x-th area gradually decreases from the first area to the i-th area.

3. The liquid guiding member according to claim 1, wherein the flow velocity $Q_x$ of the aerosol-forming substrate in the x-th area satisfies: at least one $Q_x$ is not less than the flow velocity $Q_i$ in the i-th area.

4. The liquid guiding member according to claim 1, wherein the liquid guiding member comprises at least one porous core layer; R is defined as an average pore radius of the porous core layer, the average pore radius of the porous core layer in the first area is greater than or equal to the average pore radius of the porous core layer in the i-th area, and is greater than the average pore radius of the porous core layer in the x-th area, that is, the average pore radius R in the first area to the i-th area satisfies: $R_1 \geq R_i$ and $R_1 > R_x$, $1<x<i$, i being a positive integer and $i>2$.

5. The liquid guiding member according to claim 4, wherein the average pore radius $R_x$ of the porous core layer in the x-th area satisfies: at least one $R_x$ is less than the average pore radius $R_i$ in the i-th area.

6. The liquid guiding member according to claim 5, wherein the average pore radius $R_x$ of the porous core layer in the x-th area gradually decreases from the first area to the i-th area.

7. The liquid guiding member according to claim 4, wherein the average pore radius $R_x$ of the porous core layer in the x-th area satisfies: at least one $R_x$ is not less than the average pore radius $R_i$ in the i-th area.

8. The liquid guiding member according to claim 1, wherein the liquid guiding member comprises at least one porous core layer; a porosity ε of the porous core layer in the first area to the i-th area satisfies: $\varepsilon_1 \geq \varepsilon_i$ and $\varepsilon_1 > \varepsilon_x$, $1<x<i$, i being a positive integer and $i>2$.

9. The liquid guiding member according to claim 8, wherein the porosity $\varepsilon_x$ of the porous core layer in the x-th area satisfies: at least one $\varepsilon_x$ is less than the porosity $\varepsilon_i$ in the i-th area.

10. The liquid guiding member according to claim 9, wherein the porosity $\varepsilon_x$ of the porous core layer in the x-th area gradually decreases from the first area to the i-th area.

11. The liquid guiding member according to claim 8, wherein the porosity $\varepsilon_x$ of the porous core layer in the x-th area satisfies: at least one $\varepsilon_x$ is not less than the porosity $\varepsilon_i$ in the i-th area.

12. The liquid guiding member according to claim 1, wherein the liquid guiding member comprises at least one porous core layer; a thickness L of the porous core layer in two adjacent areas satisfies: $1 \leq L_n - 1/L_n \leq 100$, n being a positive integer and $1<n \leq i$.

13. The liquid guiding member according to claim 1, wherein the liquid guiding member comprises at least two porous core layers, each of the porous core layers corresponds to one of the areas, wherein the first porous core layer of the liquid guiding member corresponds to the first area, the x-th porous core layer of the liquid guiding member corresponds to the x-th area, and the i-th porous core layer of the liquid guiding member corresponds to the i-th area.

14. The liquid guiding member according to claim 1, wherein the liquid guiding member comprises only one porous core layer, and the only one porous core layer is divided into the multiple areas.

15. The liquid guiding member according to claim 13, wherein a groove is formed in the x-th porous core layer, the groove is recessed downwardly from an upper surface of the x-th porous core layer, such that the x-th porous core layer has a U-shaped cross section in a vertical direction, and the (x−1)-th porous core layer is accommodated in the groove of the x-th porous core layer.

16. The liquid guiding member according to claim 13, wherein a groove is formed in each porous core layer from the second porous core layer to the i-th porous core layer, the groove is recessed downwardly from an upper surface of each porous core layer from the second porous core layer to the i-th porous core layer, such that each porous core layer from the second porous core layer to the i-th porous core layer has a U-shaped cross section in a vertical direction, and the (i−1)-th porous core layer is accommodated in the groove of the i-th porous core layer.

17. An atomizing core comprising a heating member and further comprising a liquid guiding member according to claim 1, wherein the liquid guiding member comprises at least one porous core layer, and the heating member is arranged on the porous core layer of the liquid guiding member adjacent to the heating member.

18. An atomizer comprising a liquid storage chamber and an atomizing cavity in communication with the liquid storage chamber, the liquid storage chamber being configured for storing an aerosol-forming substrate, a liquid outlet being provided on a wall of the liquid storage chamber, wherein the atomizer further comprises an atomizing core according to claim 17, the liquid guiding member is in fluid communication with the liquid outlet.

* * * * *